US007987538B1

(12) United States Patent
Kimball

(10) Patent No.: US 7,987,538 B1
(45) Date of Patent: Aug. 2, 2011

(54) BED SUPPORT SYSTEM AND METHOD

(75) Inventor: Carol Burk Kimball, Tempe, AZ (US)

(73) Assignee: Kimball Care Products, LLC, Tempe, AZ (US)

( * ) Notice: Subject to any disclaimer, the term of this patent is extended or adjusted under 35 U.S.C. 154(b) by 0 days.

(21) Appl. No.: 12/784,488

(22) Filed: May 20, 2010

Related U.S. Application Data

(60) Provisional application No. 61/179,810, filed on May 20, 2009.

(51) Int. Cl.
*A47C 31/00* (2006.01)

(52) U.S. Cl. ..... 5/662; 5/426; 5/425; 5/424

(58) Field of Classification Search ..... 5/662, 426, 5/425, 430, 691
See application file for complete search history.

(56) References Cited

U.S. PATENT DOCUMENTS 1,341,483 A * 5/1920 Slocum ..... 5/662
5,463,784 A * 11/1995 Alpern ..... 5/662
6,134,731 A * 10/2000 Thom et al. ..... 5/662
6,401,280 B1 * 6/2002 Baker ..... 5/662
7,197,779 B2 * 4/2007 Shalikar ..... 5/426
7,237,285 B2 * 7/2007 Brewin et al. ..... 5/426
7,454,804 B2 * 11/2008 Macari et al. ..... 5/426
7,568,249 B1 * 8/2009 Kunde et al. ..... 5/662
7,640,606 B2 * 1/2010 Flannery et al. ..... 5/662
2007/0083994 A1 * 4/2007 Miller ..... 5/662
2007/0089242 A1 * 4/2007 Battiston ..... 5/662
2007/0151032 A1 * 7/2007 Heavrin ..... 5/662

* cited by examiner

*Primary Examiner* — Robert G Santos
*Assistant Examiner* — Brittany Wilson
(74) *Attorney, Agent, or Firm* — Booth Udall, PLC

(57) ABSTRACT

A bed support system may include first and second rails each including at least two legs connected at a top thereof by a handle. A first adjustable strap and a spaced apart second adjustable strap may be placed around the legs of the first and second rails. A method of installing a bed support system on a bed on a ground may include: positioning a first adjustable strap around first and second rails so that the first strap anchors around legs of the first and second rails; positioning a bed frame over the first strap to aid in anchoring the first strap to the first and second rails; positioning a box spring onto the bed frame; and positioning a second adjustable strap over the box spring and around the first and second rails so that the second strap anchors around the legs of the first and second rails.

16 Claims, 8 Drawing Sheets

BED SUPPORT SYSTEM AND METHOD

CROSS-REFERENCE TO RELATED APPLICATION

This application claims priority to the pending provisional application entitled "System, Method, and Apparatus for Support Device for Bed", filed May 20, 2009, Ser. No. 61/179,810, the disclosure of which is entirely incorporated herein by reference.

BACKGROUND

1. Technical Field

This document relates to a bed support system and method.

2. Background

For people who have difficulty moving, are disabled, or are injured, getting in and out of bed, up and down from furniture, and otherwise maneuvering difficult areas is a challenge. A support device can help people with difficulty moving to more easily do everyday functions. However, conventional support devices are unstable when getting in and out of bed, do not anchor well to a bed or other furniture, are difficult to assemble, and may not work with conventional beds or other furniture.

SUMMARY

Aspects of this document relate to a bed support system and method. These aspects may comprise, and implementations may include, one or more or all of the components and steps set forth in the appended CLAIMS, which are hereby incorporated by reference.

In one aspect, a bed support system is disclosed that is configured to couple to a bed to help a person get in and out of bed and maneuver while in bed. The bed support system may include a first rail that may include at least two legs connected at a top thereof by a first handle. A second rail may be spaced apart from the first rail and may include at least two legs connected at a top thereof by a second handle. A first adjustable strap may be placed around the at least two legs of the first rail and the at least two legs of the second rail. A second adjustable strap may be spaced apart from the first adjustable strap and may be placed around the at least two legs of the first rail and the at least two legs of the second rail.

Particular implementations may include one or more or all of the following.

The at least two legs of both the first and second rails may be adjustable.

Both the first and second rails may comprise a substantially "A" shape with one of a flat and a curved handle.

The first and second rails may be substantially vertical and the first and second straps may be substantially horizontal.

The first adjustable strap may be placed around a lower portion of the at least two legs of the first rail and the at least two legs of the second rail, and the second adjustable strap may be spaced above the first adjustable strap and placed around one of a middle portion and an upper portion of the at least two legs of the first rail and the at least two legs of the second rail.

A side cross rail may be included and may be located between upper portions of the first and second rails so that it is above and spans a width of a bed frame.

An overhead cross rail may be included and may be located between top portions of the first and second rails so that it is above and spans a width of a bed frame.

At least one tray may be coupled to one of the first rail and the second rail. The at least one tray may swivel.

At least one drink holder and/or a hydration device may be coupled to either the first rail or the second rail or both.

At least one light may be coupled to one of the first rail and the second rail.

At least one electrical outlet may be coupled to either the first rail or the second rail or both.

A foot step may be coupled to either the first rail or the second rail or both.

In another aspect, a bed support system is disclosed that is configured to couple to a bed to help a person get in and out of bed and maneuver while in bed. The bed support system may include a first vertical rail including at least two adjustable legs connected at a top thereof by a first handle. A second vertical rail may be spaced apart from the first rail and include at least two adjustable legs connected at a top thereof by a second handle. A first horizontal adjustable strap may be placed around the at least two legs of the first rail and the at least two legs of the second rail. A second horizontal adjustable strap spaced apart from the first adjustable strap may be placed around the at least two legs of the first rail and the at least two legs of the second rail. A bed frame may be coupled to the first and second rails using the first strap.

Particular implementations may include one or more or all of the following.

The first adjustable strap may be placed around a lower portion of the at least two legs of the first rail and the at least two legs of the second rail, and the second adjustable strap may be spaced above the first adjustable strap and placed around one of a middle portion and an upper portion of the at least two legs of the first rail and the at least two legs of the second rail.

A mattress or a box spring or both may be placed on top of the bed frame to aid in anchoring the first strap to the first and second rails. The mattress or the box spring may be coupled to the first and second rails using the first and second straps. The first adjustable strap may be placed adjacently below the bed frame. The second adjustable strap may be spaced adjacently above the mattress or the box spring.

In still another aspect, a bed support method is disclosed for configuring, assembling and installing a bed support system to a bed to help a person get in and out of bed and maneuver while in bed. The method may include: positioning a first adjustable strap around first and second rails so that the first strap anchors around first and second legs of the first rail and third and fourth legs of the second rail; positioning a bed frame over the first strap and within the first rail and the second rail near the first and second legs and the third and fourth legs to aid in anchoring the first strap to the first and second rails; positioning a box spring onto the bed frame; and positioning a second adjustable strap over the box spring and around the first and second rails so that the second strap anchors around first and second legs of the first rail and third and fourth legs of the second rail.

Particular implementations may include one or more or all of the following.

Prior to positioning a first adjustable strap around first and second rails, the method may include positioning a first rail and a second rail a width of the bed apart and in an upright position to the ground.

Prior to positioning a box spring onto the bed frame, the method may include positioning the first and second rails on an outside perimeter of the bed frame.

The method may include positioning a mattress onto the box spring and over the second strap to aid in anchoring the second strap to first and second rails.

The method may include cinching the first and second straps so that the first and second rails are held tight against at least the bed frame.

The foregoing and other aspects and implementations of a bed support system and method and method may have one or more or all of the following advantages, as well as other benefits discussed elsewhere in this document.

Implementations may help people who have difficulty moving, are disabled, or are injured, get in and out of bed, and otherwise maneuver while in bed. Implementations are stable when getting in and out of bed, anchor well to a bed or other furniture, and are easy to assemble. Implementations incorporate easy assembly and installation to the bed, custom configuration to aid people of substantially all heights and weights, and mobility from one bed to another. Implementations allow for conventional use of a bed and use of a bed skirt, coverings, or other accessories. Implementations do not require modifications to a conventional bed, so that it is easy to use and compatible with all types and sizes of beds. Implementations can also be used with other types of furniture depending on the need of the person using it.

The foregoing and other aspects, features, and advantages will be apparent to those of ordinary skill in the art from the DESCRIPTION and DRAWINGS, and from the CLAIMS.

BRIEF DESCRIPTION OF DRAWINGS

Implementations will hereinafter be described in conjunction with the appended DRAWINGS (which are not necessarily to scale), where like designations denote like elements, and.

DESCRIPTION

Figure 1:
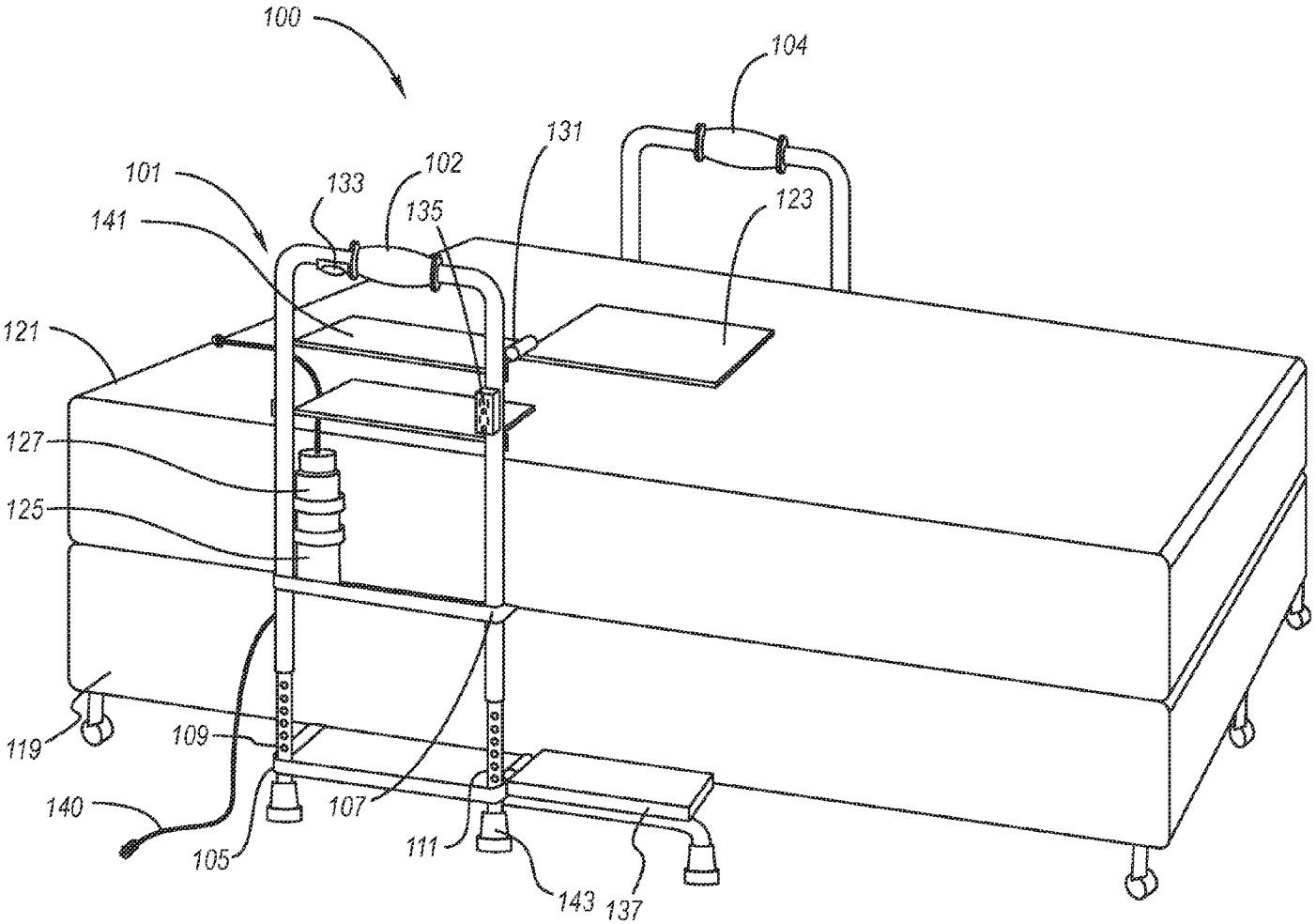
FIG. 1 is a perspective view of an implementation of a bed support system.

This document features bed support system and method implementations that help people who have difficulty moving, are disabled, or are injured, get in and out of bed, and otherwise maneuver while in bed. Bed support system and method implementations are stable, anchor well to a bed or other furniture, are easy to assemble, can be custom configured to aid people of substantially all heights and weights, and are mobile from one bed to another. Thus, there are many features of bed support system and method implementations disclosed herein, of which one, a plurality, or all features or steps may be used in any particular implementation.

In the following description, reference is made to the accompanying DRAWINGS which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure.

Structure

There are a variety of bed support system implementations that are configured to removably couple to a bed to help people of substantially all heights and weights get in and out of bed safely and maneuver while in bed. Notwithstanding, turning to FIG. 1 and for the exemplary purposes of this disclosure, bed support system 100 is shown. Bed support system 100 generally includes a first side rail 101, a second side rail 103, a first strap 105, and a second strap 107.

First rail 101 can be one rail of a typical walker or walking frame used by people who are elderly or injured. Second rail 103 can be the other rail of the typical walker or walking frame. A typical walker or walking frame is about waist high, wide enough for a person to stand within it, and adjustable for height (and width). First and second rails 101 and 103 can be any other type of rail, frame, or structure that is suitable for use as a support device.

First rail 101 and second rail 103 may be positioned about the width of a bed apart as illustrated in FIG. 1. The width will depend on the size of bed being used (e.g. single, twin, queen, king. hospital or medical sizes, or any other size). The height of first and second rails 101 and 103 is adjustable via legs 109 and 11 ion rail 101 and similar legs on rail 103, depending on the person using bed support system 100.

First strap 105 may be positioned around (e.g., wrapped around) first and second rails 101 and 103, so that first strap 105 anchors onto first and second legs 109 and 111 of first rail 101 and third and fourth legs of second rail 103. As depicted, first strap 105 can be positioned near the ground (such as just below a bed frame. However, first strap 105 can be positioned anywhere along first and second rails 101 and 103 (e.g., further above the ground (such as above a bed frame or above a box spring 119)). One or more D-rings, double D-rings, buckles, clips, or the like may adjustably hold first strap 105 securely together and around first rail 101 and second rail 103. Thus, by using for example double D-rings 106 (as shown in FIGS. 5-8), first strap 105 is adjustable for any size bed. Double D-rings allow first strap 105 to be securely tightened around first and second rails 101 and 103 and a bed frame 117 (or under a bed frame). The height of first rail 101 is adjustable using the pin and hole adjustments on first and second legs 109 and 111 and the height of second rail 103 is adjustable using similar pin and hole adjustments on third and fourth legs.

A bed frame may be positioned over first strap 105 and within first rail 101 and second rail 103 near first and second legs 109 and 111 and third and fourth legs of rail 103 (that is, first and second rails 101 and 103 are positioned on the outside of bed frame 117). First strap 105 securely anchors first and second rails 101 and 103 onto a bed frame.

A box spring or other type of mattress 119 may be positioned onto a bed frame and can aid in anchoring first strap 105 to first and second rails 101 and 103 and a bed frame. While not shown, a covering, bed skirt, or other accessory may be positioned onto box spring 119.

Double D-rings 108 may adjustably hold second strap 107 securely together and around first and second rails 101 and 103. By using double D-rings 108, second strap 107 is adjustable for any size bed. Double D-rings 108 allow second strap 107 to be securely tightened around first and second rails 101 and 103 (e.g., such as toward the upper portion or above first and second legs 109 and 111 and third and fourth legs, or directly above box spring 119). Second strap 107 can be positioned (e.g., wrapped around) anywhere along first and second rails 101 and 103.

Any further adjustments to first and second straps 105 and 107 can be made to securely anchor first and second rails 101 and 103 onto/against bed frame 117 and box spring 119, and to each other. A second mattress 121 can be positioned onto box spring 119 and over second strap 107 and can further aid in anchoring first strap 105 and second strap 107 to first and second rails 101 and 103, a bed frame, and box spring 119. While not shown, a covering, bed sheet, or other accessory may be positioned onto mattress 121.

Thus, bed support system 100 includes first rail 101 coupled to second rail 103 using first strap 105, where first and second rails 101 and 103 are upright or vertical to the ground and first strap 105 is parallel to the ground. Bed support system 100 may include a bed frame coupled to first and second rails 101 and 103 using first strap 105. Bed support system 100 may include box spring 119 coupled to a bed frame and first and second rails 101 and 103. Bed support system 100 may include second strap 107 around first and second rails 101 and 103 to further couple first and second rails 101 and 103 to each other and to a bed frame and box spring 119. First and second straps 105 and 107 can be adjustably secured onto first and second rails 101 and 103 using one or more double D-rings 106 and 108.

Bed support system 100 may also include one or more trays 123, 141, and 142 for eating, placing medications, or any other use. Tray 123 for example can swivel 360 degrees (such as with an arm or joint 131) about first rail 101 and/or second rail 103. Bed support system 100 may also include one or more drink holders 125 or other hydration device 127 coupled to rail 101 and/or 103. For example, hydration device 127 can be a container with a straw having a valve in which the straw can be clipped to a pillow for easy drinking. Bed support system 100 may include one or more lights 133 that can be connected to one or more electrical outlets 135 and/or another power source via electrical cord 140. Electrical outlet 135 can be separate from or incorporated into first rail 101 and/or second rail 103 to allow for easy use of electrical devices while in bed, and can be coupled to a power source via electrical cord 140.

First and second legs 109 and 111 and third and fourth legs are adjustable for the height of first and second rails 101 and 103. Bed support system 100 can be used with any height bed and for any height person. First and second handles 102 and 104 are positioned at a height that is comfortable for the particular person's height. A foot step 137 allows for further adjustments in height, so that a person can easily get in and out of bed, furniture, or other areas. Non-slip feet 143 may be coupled to first and second legs 109 and 111 and third and fourth legs. Non-slip feet 143 protect the flooring and can aid in preventing the legs from slipping on the flooring.

In order to aid in getting in and out of bed, up and down from furniture, and otherwise maneuvering difficult areas, a first handle 102 of first rail 101 and/or a second handle 104 of second rail 103 can be gripped and used to pull oneself into, onto, and out of a bed, furniture, or other area. First handle 102 and/or second handle 104 can be used to maneuver around once in or on the bed, furniture, or other area.

Other Implementations

There are many additional implementations.

Figure 2:
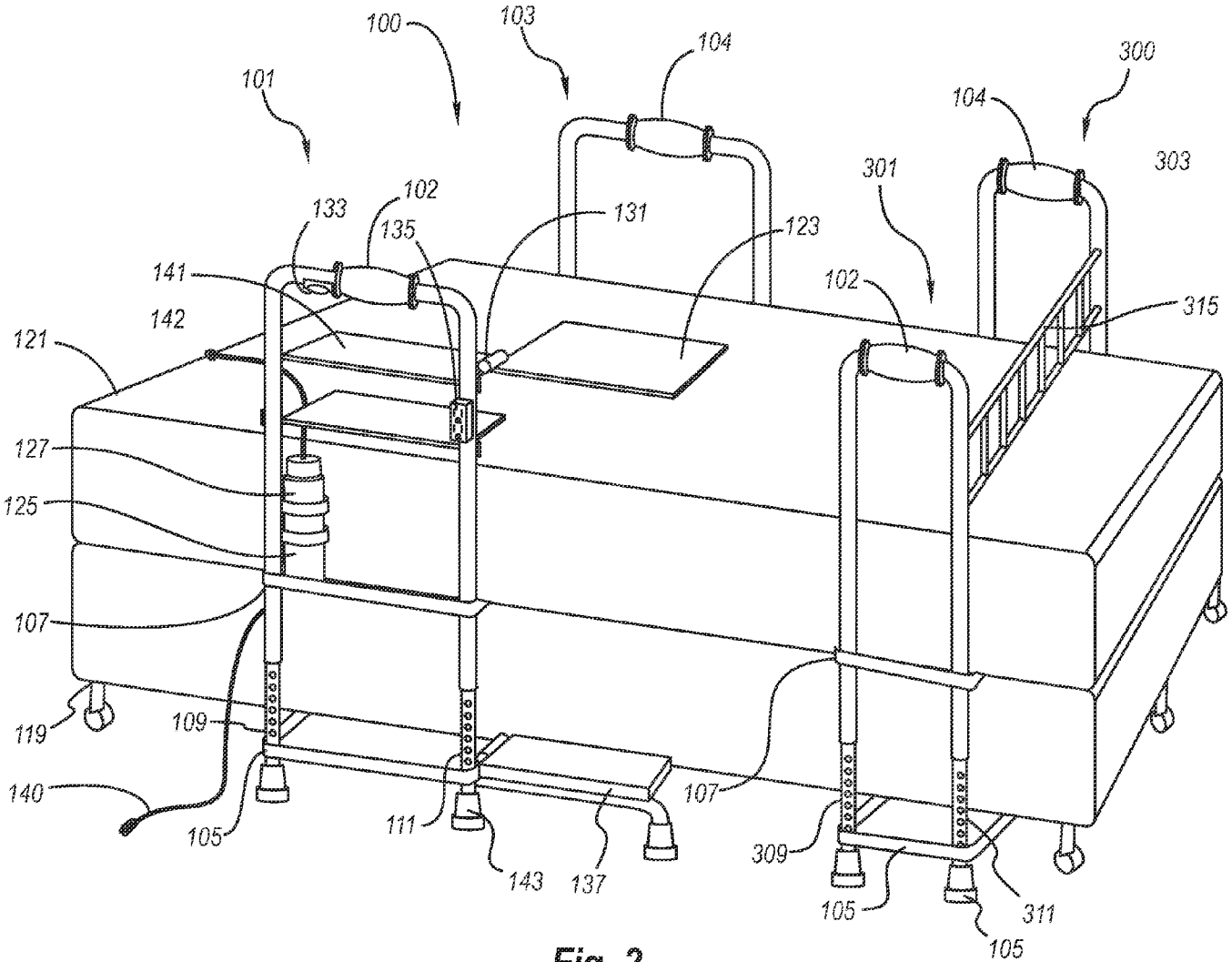
FIG. 2 is a perspective view of another implementation of a bed support system.

Turning to FIG. 2 and for the exemplary purposes of this disclosure, bed support system 300 is shown in use with bed support system 100, but bed support system 300 could be used as a standalone system as well. Bed support system 300 is similar to bed support system 100 as previously described. Bed support system 300 generally includes a first side rail 301, a second side rail 303, a cross rail 315, a first strap 105, and a second strap 107.

First and second rails 301 and 303 can be any type of rail, frame, or structure that is suitable for use as a support device. First rail 301 and second rail 303 may be positioned about the width of a bed apart as illustrated in FIG. 2. The height of first and second rails 301 and 303 is adjustable via legs 309 and 31 ion rail 301 and similar legs on rail 303, depending on the person using bed support system 300. Cross rail 315 may be included between rails 301 and 300 so that it is above and spans the width of the bed frame and box spring 119 and mattress 121. Cross rail 315 aids a person in getting in and out of bed, up and down from furniture, and otherwise maneuvering difficult areas. A person can just push with their legs against cross rail 315.

First strap 105 may be positioned around (e.g., wrapped around) first and second rails 301 and 303, so that first strap 105 anchors onto first and second legs 309 and 311 of first rail 301 and third and fourth legs of second rail 303. As depicted, first strap 105 can be positioned near the ground (such as just below a bed frame). However, first strap 105 can be positioned anywhere along first and second rails 301 and 303 (e.g., further above the ground (such as above a bed frame or above a box spring 119)). One or more D-rings, double D-rings, buckles, clips, or the like may adjustably hold first strap 105 securely together and around first rail 301 and second rail 303. Thus, by using for example double D-rings 106 (as shown in FIGS. 5-8), first strap 105 is adjustable for any size bed. Double D-rings allow first strap 105 to be securely tightened around first and second rails 301 and 303 and a bed frame or under a bed frame). The height of first rail 301 is adjustable using the pin and hole adjustments on first and second legs 309 and 311 and the height of second rail 303 is adjustable using similar pin and hole adjustments on third and fourth legs.

A bed frame may be positioned over first strap 105 and within first rail 301 and second rail 303 near first and second legs 309 and 311 and third and fourth legs of rail 303 (that is, first and second rails 301 and 303 are positioned on the outside of bed frame 117). First strap 105 securely anchors first and second rails 301 and 303 onto a bed frame.

A box spring or other type of mattress 119 may be positioned onto a bed frame and can aid in anchoring first strap 105 to first and second rails 301 and 303 and a bed frame. While not shown, a covering, bed skirt, or other accessory may be positioned onto box spring 119.

Double D-rings 108 may adjustably hold second strap 107 securely together and around first and second rails 301 and 303. By using double D-rings 108, second strap 107 is adjustable for any size bed. Double D-rings 108 allow second strap 107 to be securely tightened around first and second rails 301 and 303 (e.g., such as toward the upper portion or above first and second legs 309 and 311 and third and fourth legs, or directly above box spring 119). Second strap 107 can be positioned (e.g., wrapped around) anywhere along first and second rails 301 and 303.

Any further adjustments to first and second straps 105 and 107 can be made to securely anchor first and second rails 301 and 303 onto/against bed frame 117 and box spring 119, and to each other. A second mattress 121 can be positioned onto box spring 119 and over second strap 107 and can further aid in anchoring first strap 105 and second strap 107 to first and second rails 301 and 303, a bed frame, and box spring 119. While not shown, a covering, bed sheet, or other accessory may be positioned onto mattress 121.

Thus, bed support system 300 includes first rail 301 coupled to second rail 303 using first strap 105, where first and second rails 301 and 303 are upright or vertical to the ground and first strap 105 is parallel to the ground. Cross rail 315 is between rails 301 and 300 so that it is above and spans the width of the bed frame and box spring 119 and mattress 121. Bed support system 300 may include a bed frame coupled to first and second rails 301 and 303 using first strap 105. Bed support system 300 may include box spring 119 coupled to a bed frame and first and second rails 301 and 303. Bed support system 300 may include second strap 107 around first and second rails 301 and 303 to further couple first and second rails 301 and 303 to each other and to a bed frame and box spring 119. First and second straps 105 and 107 can be adjustably secured onto first and second rails 301 and 303 using one or more double D-rings 106 and 108.

First and second legs 309 and 311 and third and fourth legs are adjustable for the height of first and second rails 301 and 303. Bed support system 300 can be used with any height bed and for any height person. First and second handles 302 and 304 are positioned at a height that is comfortable for the particular person's height. Non-slip feet 143 may be coupled to first and second legs 309 and 311 and third and fourth legs.

In order to aid in getting in and out of bed, up and down from furniture, and otherwise maneuvering difficult areas, cross rail 315, a first handle 302 of first rail 301 and/or a second handle 304 of second rail 303 can be gripped and used to push or pull oneself into, onto, and out of a bed, furniture, or other area. Cross rail 315, first handle 302 and/or second handle 304 can be used to maneuver around once in or on the bed, furniture, or other area.

Figure 3:
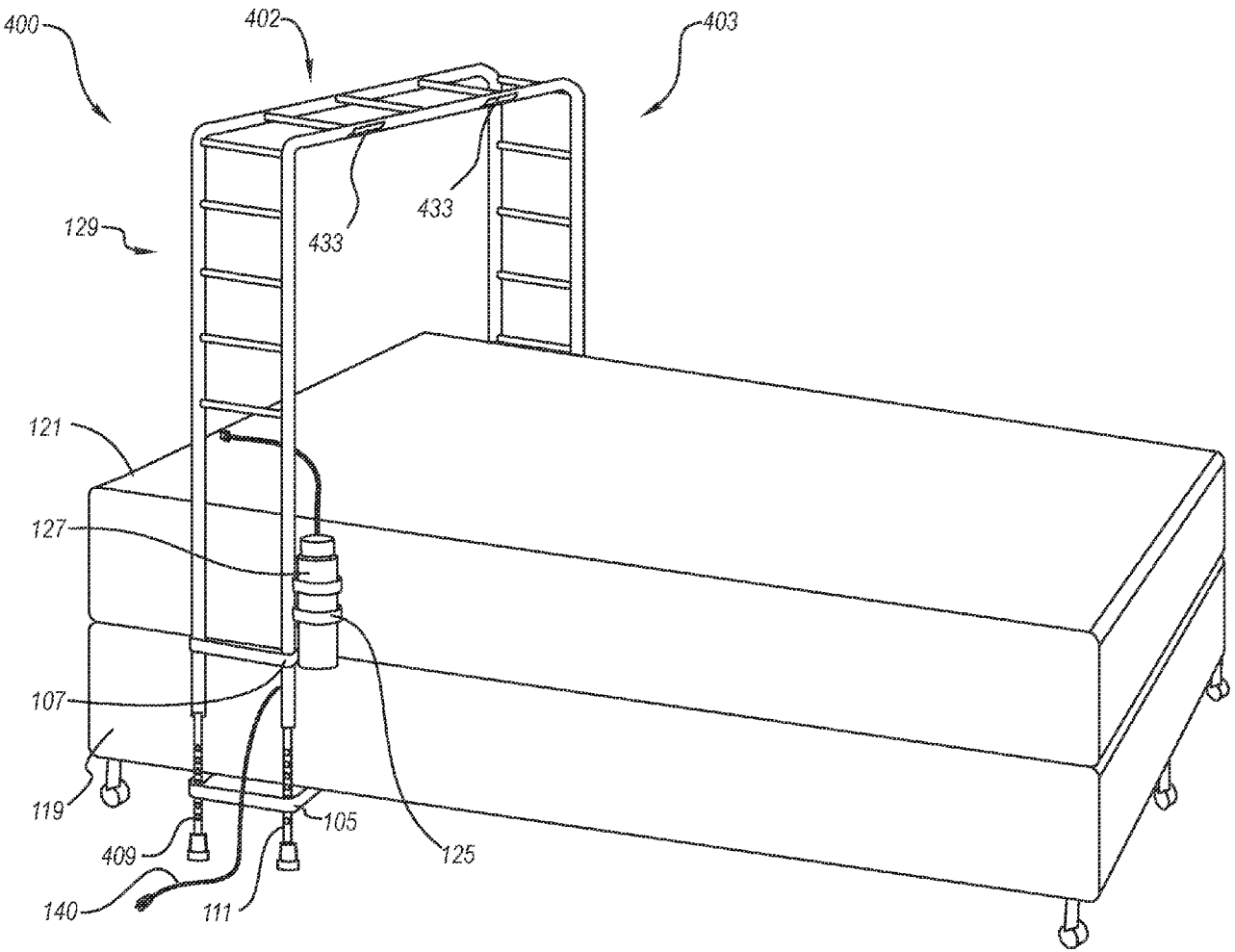
FIG. 3 is a perspective view of still another implementation of a bed support system.

Turning to FIG. 3 and for the exemplary purposes of this disclosure, bed support system 400 is shown. Bed support system 400 includes an overhead rail 402 to further aid a person in getting in and out of bed, up and down from furniture, and otherwise maneuvering difficult areas. Bed support system 400 can be stand-alone as shown and completely separate from any other bed support system, such as bed support systems 100 and 300 as previously described. Alternatively, bed support system 400 can be attached to any other bed support system, such as bed support system 100 as previously described, or bed support system 400 can be integrated into (that is positioned into first and second rails so as to form a part of the first and second rails) any other bed support system, such as bed support system 100, to form a new bed support system, such as bed support system 500 described below.

Bed support system 400 is similar to bed support systems 100 and 300 as previously described. Bed support system 400 generally includes a first side rail 401, a second side rail 403, a third overhead rail 402, a first strap 105, and a second strap 107.

First and second rails 401 and 403 can be any type of rail, frame, or structure that is suitable for use as a support device. First rail 401 and second rail 403 may be positioned about the width of a bed apart as illustrated in FIG. 3. The height of first and second rails 401 and 403 is adjustable via legs 409 and 411 on rail 401 and similar legs on rail 403, depending on the person using bed support system 400. Overhead cross rail 402 may be included between rails 401 and 402 so that it is above and spans the width of the bed frame and box spring 119 and mattress 121 Overhead cross rail 402 aids a person in getting in and out of bed, up and down from furniture, and otherwise maneuvering difficult areas. A person can just pull up on cross rail 402, and the rungs on each rail 401, 402, and 403 allow a user many options to pull or maneuver oneself around.

First strap 105 may be positioned around (e.g., wrapped around) first and second rails 401 and 403, so that first strap 105 anchors onto first and second legs 409 and 411 of first rail 301 and third and fourth legs of second rail 403. As depicted, first strap 105 can be positioned near the ground (such as just below a bed frame). However, first strap 105 can be positioned anywhere along first and second rails 401 and 403 (e.g., further above the ground (such as above a bed frame or above a box spring 119)). One or more D-rings, double D-rings, buckles, clips, or the like may adjustably hold first strap 105 securely together and around first rail 401 and second rail 403. Thus, by using for example double D-rings 106 (as shown in FIGS. 5-8), first strap 105 is adjustable for any size bed. Double D-rings allow first strap 105 to be securely tightened around first and second rails 401 and 403 and a bed frame or under a bed frame). The height of first rail 401 is adjustable using the pin and hole adjustments on first and second legs 409 and 411 and the height of second rail 403 is adjustable using similar pin and hole adjustments on third and fourth legs.

A bed frame may be positioned over first strap 105 and within first rail 401 and second rail 403 near first and second legs 409 and 4 and third and fourth legs of rail 403 (that is, first and second rails 401 and 403 are positioned on the outside of the bed frame). First strap 105 securely anchors first and second rails 401 and 403 onto a bed frame.

A box spring or other type of mattress 119 may be positioned onto a bed frame and can aid in anchoring first strap 105 to first and second rails 401 and 403 and a bed frame. While not shown, a covering, bed skirt, or other accessory may be positioned onto box spring 119.

Double D-rings 108 may adjustably hold second strap 107 securely together and around first and second rails 401 and 403. By using double D-rings 108, second strap 107 is adjustable for any size bed. Double D-rings 108 allow second strap 107 to be securely tightened around first and second rails 401 and 403 (e.g., such as toward the upper portion or above first and second legs 409 and 411 and third and fourth legs, or directly above box spring 119). Second strap 107 can be positioned (e.g., wrapped around) anywhere along first and second rails 401 and 403.

Any further adjustments to first and second straps 105 and 107 can be made to securely anchor first and second rails 401 and 403 onto/against the bed frame and box spring 119, and to each other. A second mattress 121 can be positioned onto box spring 119 and over second strap 107 and can further aid in anchoring first strap 105 and second strap 107 to first and second rails 401 and 403, a bed frame, and box spring 119. While not shown, a covering, bed sheet, or other accessory may be positioned onto mattress 121.

Bed support system 400 may include one or more lights 433 that can be connected to one or more electrical outlets 135 (not shown in this FIG. 3, but shown in FIG. 1) and/or another power source via electrical cord 140. Electrical outlet 135 can be separate from or incorporated into first rail 401 and/or second rail 403 to allow for easy use of electrical devices while in bed, and can be coupled to a power source via electrical cord 140.

Thus, bed support system 400 includes first rail 401 coupled to second rail 403 via first strap 105 and overhead cross rail 402, where first and second rails 401 and 403 are upright or vertical to the ground and first strap 105 and overhead cross rail 402 is parallel to the ground. Cross rail 402 is between rails 401 and 403 so that it is above and spans the width of the bed frame and box spring 119 and mattress 121. Bed support system 400 may include a bed frame coupled to first and second rails 401 and 403 using first strap 105. Bed support system 400 may include box spring 119 coupled to a bed frame and first and second rails 401 and 403. Bed support system 400 may include second strap 107 around first and second rails 401 and 403 to further couple first and second rails 401 and 403 to each other and to a bed frame and box spring 119. First and second straps 105 and 107 can be adjustably secured onto first and second rails 401 and 403 using one or more double D-rings 106 and 108.

First and second legs 409 and 411 and third and fourth legs are adjustable for the height of first and second rails 401 and 403. Bed support system 400 can be used with any height bed and for any height person. First and second handles 402 and 404 are positioned at a height that is comfortable for the particular person's height. Non-slip feet 143 may be coupled to first and second legs 409 and 411 and third and fourth legs.

In order to aid in getting in and out of bed, up and down from furniture, and otherwise maneuvering difficult areas, the rungs of side rails 401 and 403 and cross rail 402 can be gripped and used to push or pull oneself into, onto, up from, and out of a bed, furniture, or other area. Side rails 401 and 403 and cross rail 402 can be used to maneuver around once in or on the bed, furniture, or other area.

Figure 4:
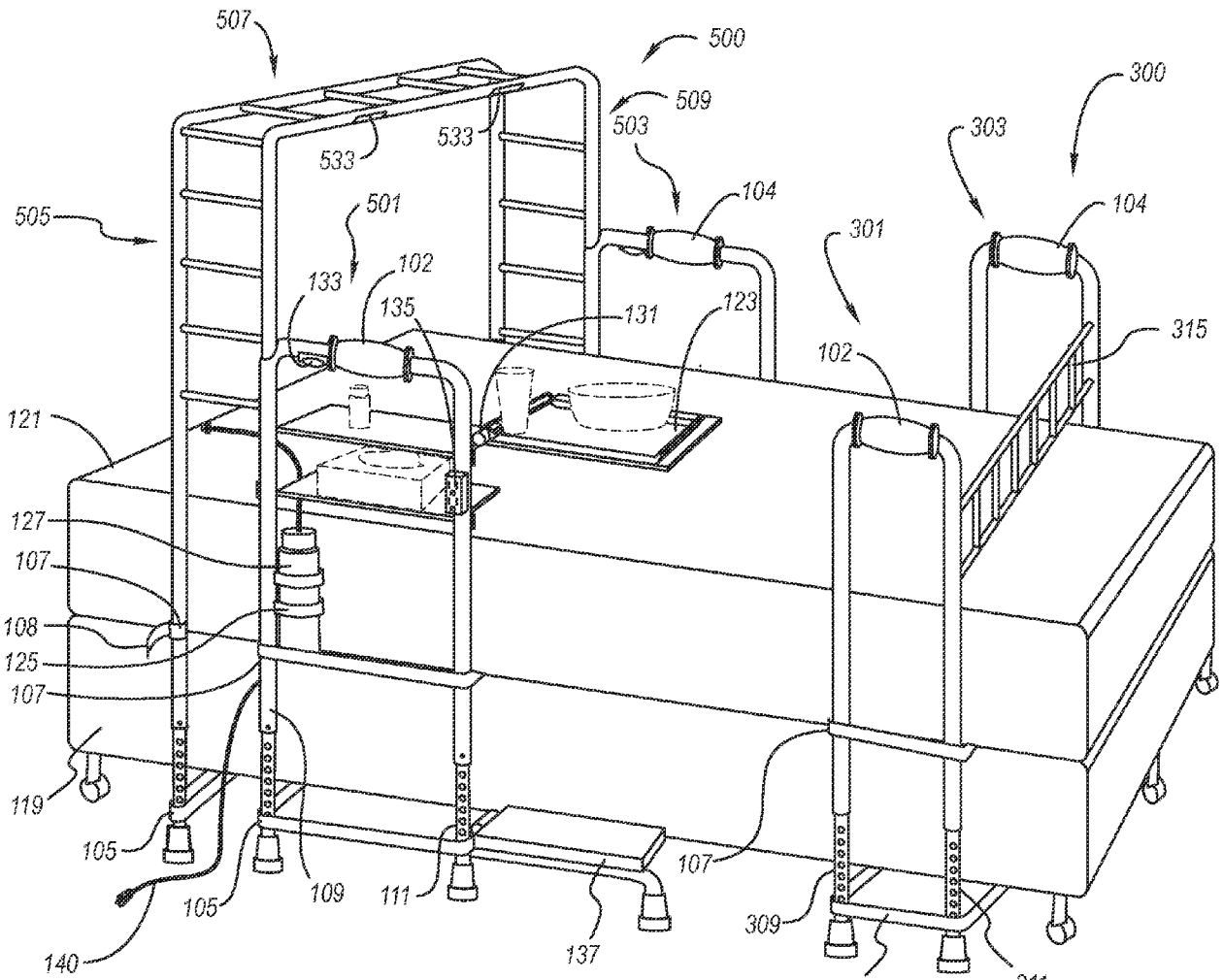
FIG. 4 is a perspective view of yet another implementation of a bed support system.
Figure 5:
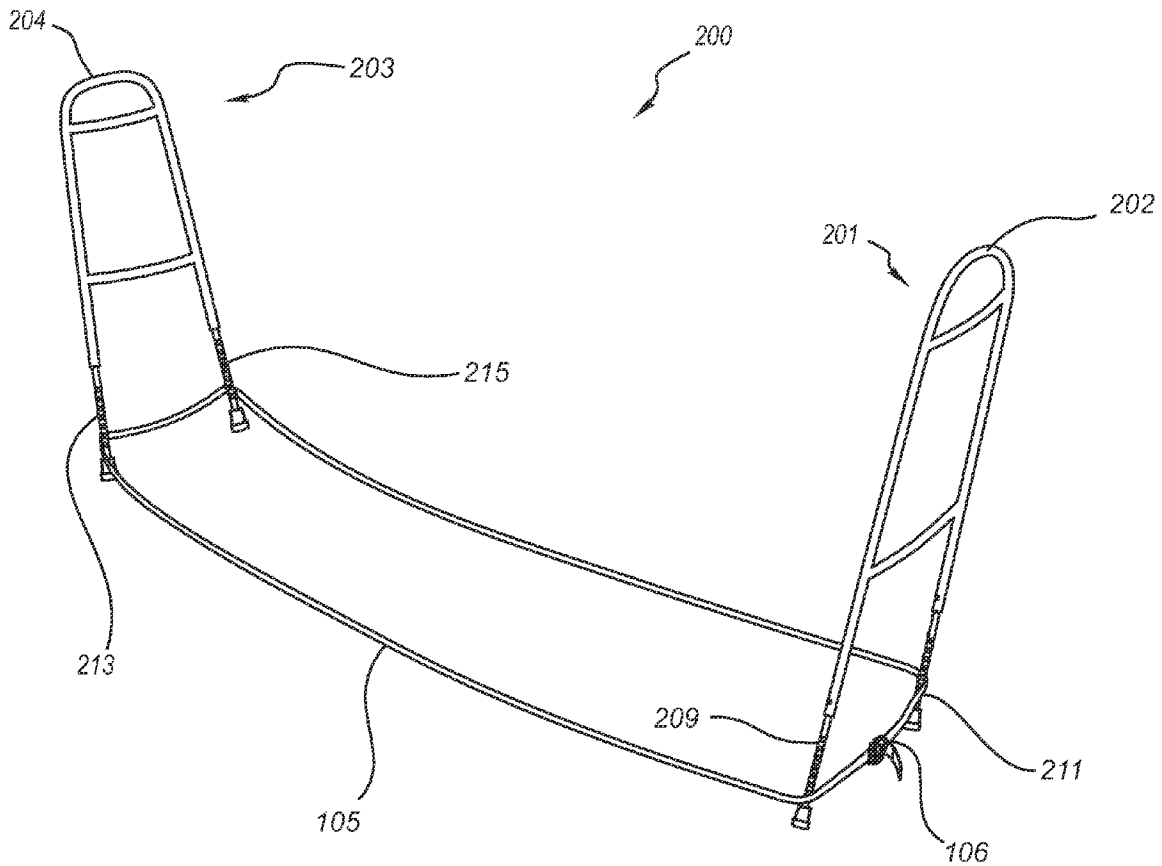
FIGS. 5-8 are perspective views of even another implementation of a bed support system during a method of assembly/installation thereof to a bed.
Figure 6:
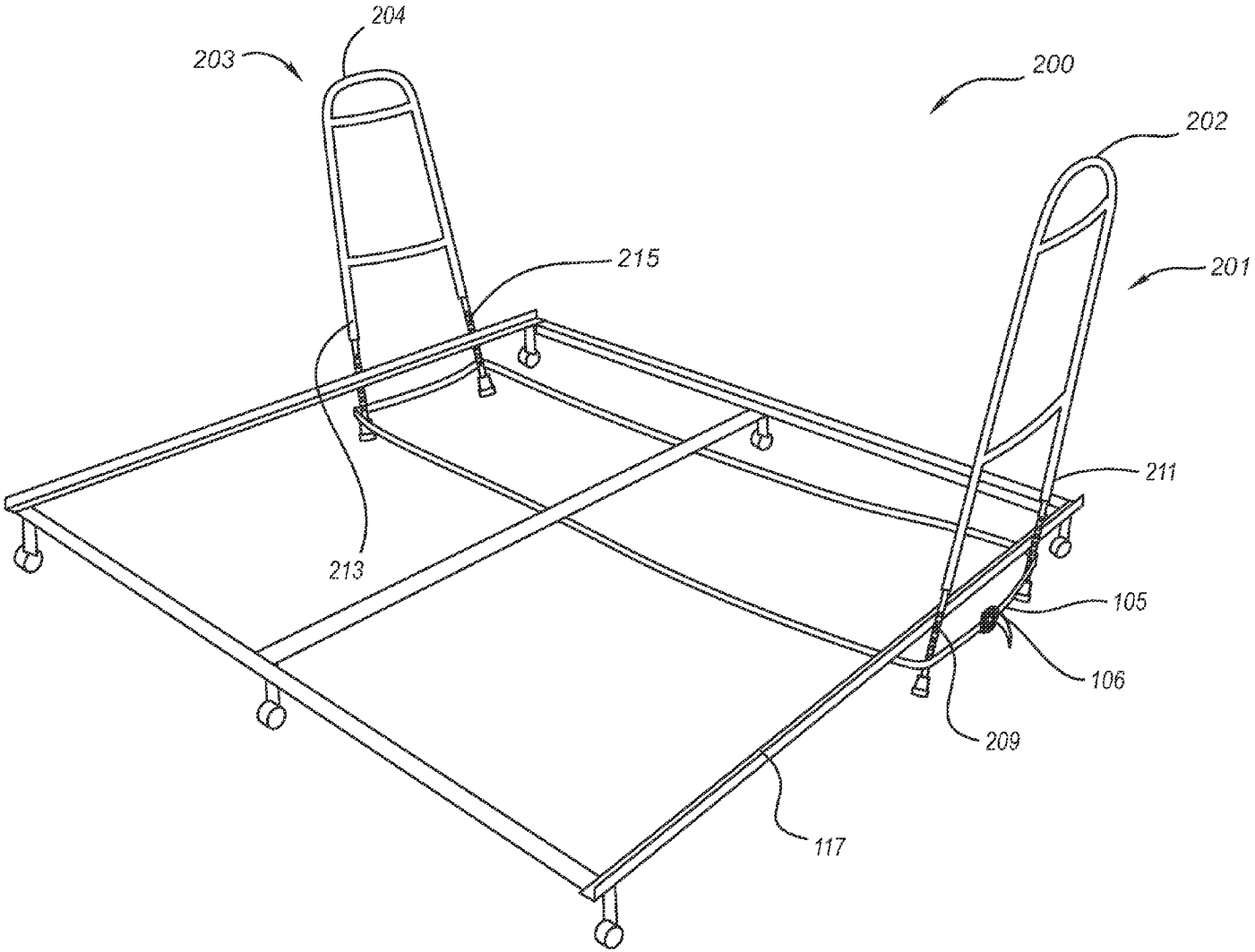
Figure 7:
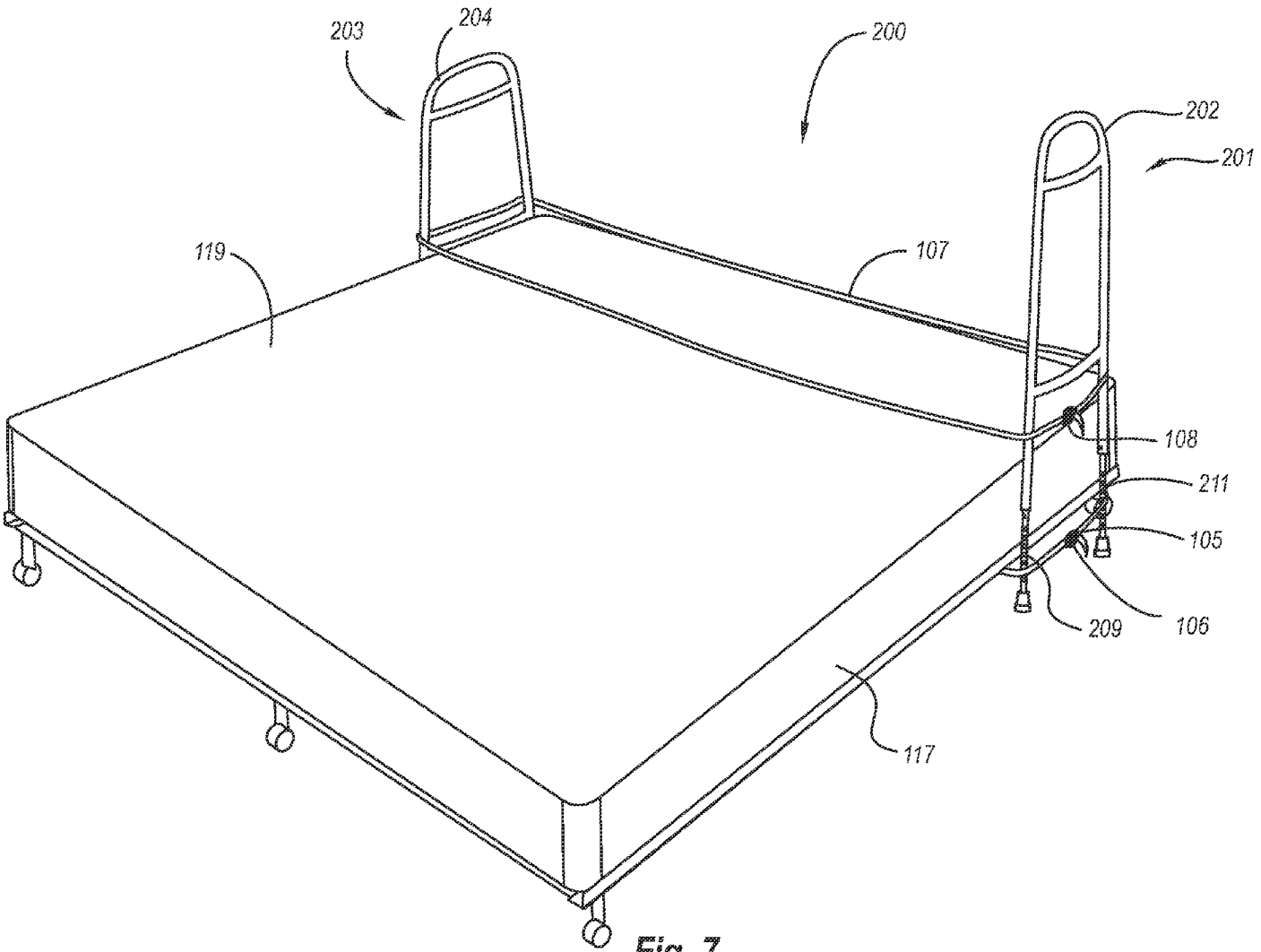
Figure 8:
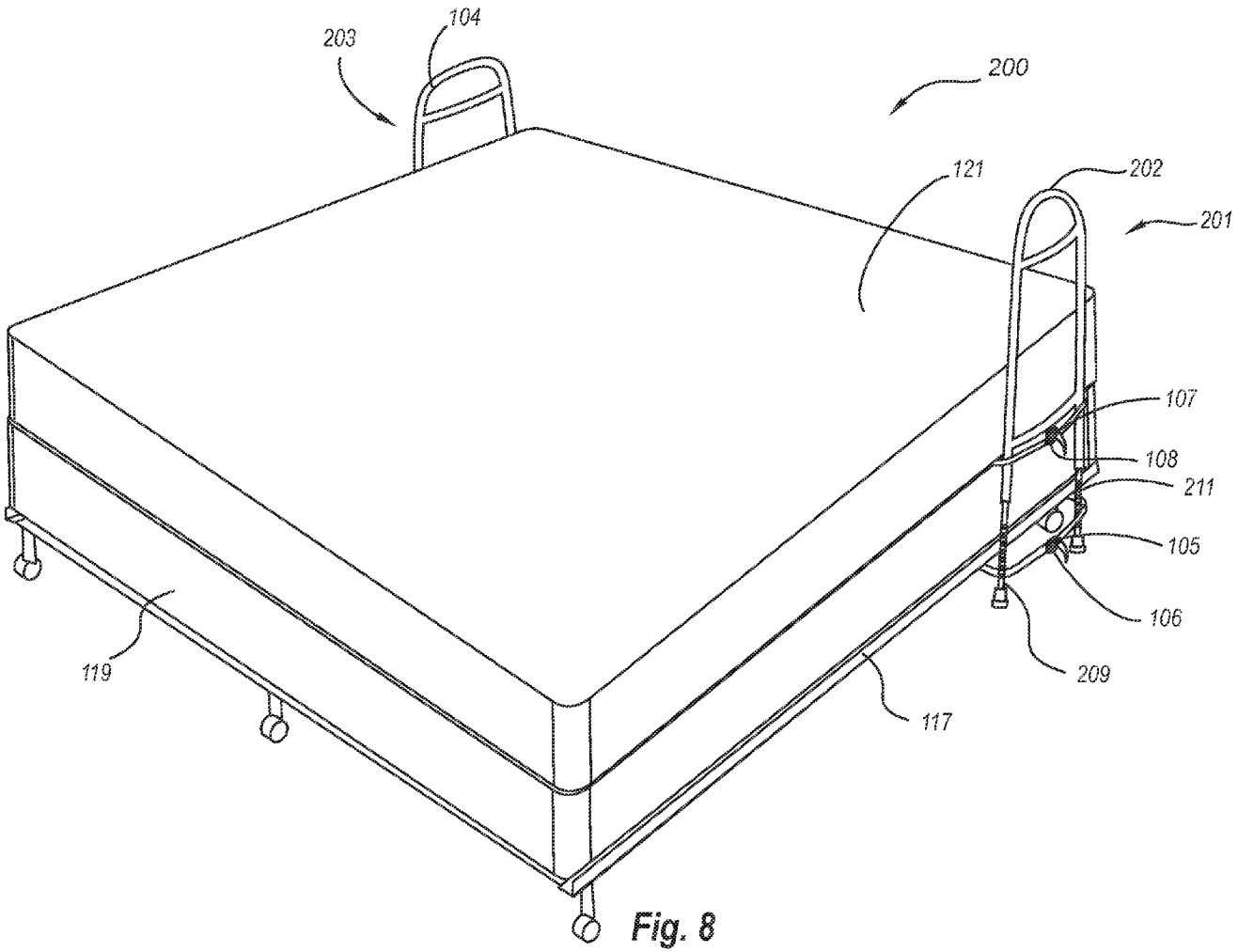

Turning to FIG. 4 and for the exemplary purposes of this disclosure, bed support system 500 is shown in use with bed support system 300, but bed support system 500 could be used as a standalone system as well. Bed support system 500 is similar to bed support system 100 and bed support system 400 as previously described. Bed support system 500 essentially integrates bed support system 100 and bed support system 400 together into a single system, although bed support system 100 and bed support system 400 could just be coupled together for example.

Bed support system 400 generally includes a first side rail 501 and a second side rail 503 integrated with (sharing a common rail member) a third side rail 505 and a fourth side rail 509 respectively. A fifth overhead rail 507 between third side rail 505 and a fourth side rail 509, a first straps 105, and second straps 107 are also included.

First side rail 501, second side rail 503, third side rail 505 and fourth side rail 509 can be any type of rail, frame, or structure that is suitable for use as a support device. First side rail 501, second side rail 503, third side rail 505 and fourth side rail 509 may be positioned about the width of a bed apart as illustrated in FIG. 4. The height of first side rail 501, second side rail 503, third side rail 505 and fourth side rail 509 is adjustable via legs on first side rail 501, second side rail 503, third side rail 505, depending on the person using bed support system 400. Overhead cross rail 507 may be included between rails 505 and 509 so that it is above and spans the width of the bed frame and box spring 119 and mattress 12. Overhead cross rail 507 aids a person in getting in and out of bed, up and down from furniture, and otherwise maneuvering difficult areas. A person can just pull up on cross rail 507, and the rungs on each rail 507, 509, and 505 allow a user many options to pull or maneuver oneself around.

First straps 105 may be positioned around (e.g., wrapped around) first and second rails 501 and 503 and third side rail 505 and fourth side rail 509, respectively, so that first straps 105 anchor onto first and second legs 509 and 511 of first rail 501 and third and fourth legs of second rail 503, and first and second legs of third side rail 505 and fourth side rail 509, respectively. As depicted, first straps 105 can be positioned near the ground (such as just below a bed frame). However, first straps 105 can be positioned anywhere along first side rail 501, second side rail 503, third side rail 505 and fourth side rail 509 (e.g., further above the ground (such as above a bed frame or above a box spring 119)). One or more D-rings, double D-rings, buckles, clips, or the like may adjustably hold first straps 105 securely together and around first side rail 501 and second side rail 503 and third side rail 505 and fourth side rail 509. Thus, by using for example double D-rings 106 (as shown in FIGS. 5-8), first straps 105 are adjustable for any size bed. Double D-rings allow first straps 105 to be securely tightened around first side rail 501 and second side rail 503 and third side rail 505 and fourth side rail 509 and a bed frame or under a bed frame). The height of first side rail 501, second side rail 503, third side rail 505 and fourth side rail 509 is adjustable using the pin and hole adjustments on their respective legs.

A bed frame may be positioned over first strap 105 and within first rail 401 and second rail 403 near first and second legs 409 and 4 and third and fourth legs of rail 403 (that is, first and second rails 401 and 403 are positioned on the outside of the bed frame). First strap 105 securely anchors first and second rails 401 and 403 onto a bed frame.

A box spring or other type of mattress 119 may be positioned onto a bed frame and can aid in anchoring first strap 105 to first and second rails 401 and 403 and a bed frame. While not shown, a covering, bed skirt, or other accessory may be positioned onto box spring 119.

Double D-rings 108 may adjustably hold second straps 107 securely together and around first side rail 501, second side rail 503, third side rail 505 and fourth side rail 509. By using double D-rings 108, second straps 107 are adjustable for any size bed. Double D-rings 108 allow second straps 107 to be securely tightened around first side rail 501, second side rail 503, third side rail 505 and fourth side rail 509 (e.g., such as toward the upper portion or above the legs, or directly above box spring 119). Second straps 107 can be positioned (e.g., wrapped around) anywhere along first side rail 501, second side rail 503, third side rail 505 and fourth side rail 509.

Any further adjustments to first and second straps 105 and 107 can be made to securely anchor first side rail 501, second side rail 503, third side rail 505 and fourth side rail 509 onto/against the bed frame and box spring 119, and to each other. A second mattress 121 can be positioned onto box spring 119 and over second straps 107 and can further aid in anchoring first straps 105 and second straps 107 to first side rail 501, second side rail 503, third side rail 505, fourth side rail 509, a bed frame, and box spring 119. While not shown, a covering, bed sheet, or other accessory may be positioned onto mattress 121.

Bed support system 500 may include one or more lights 533 that can be connected to one or more electrical outlets 135 (not shown in this FIG. 4, but shown in FIG. 1) and/or another power source via electrical cord 140. Electrical outlet 135 can be separate from or incorporated into first side rail 501, second side rail 503, third side rail 505 and/or fourth side rail 509 to allow for easy use of electrical devices while in bed, and can be coupled to a power source via electrical cord 140.

Thus, bed support system 500 includes first side rail 501 coupled to second side rail 503 via first strap 105, and third side rail 505 coupled to fourth side rail 509 via first strap 105 and overhead cross rail 402. First side rail 501 and second side rail 503 are each integrated with third side rail 505 and fourth side rail 509, respectively. First side rail 501, second side rail 503, third side rail 505 and fourth side rail 509 are upright or vertical to the ground and first straps 105 and overhead cross rail 507 is parallel to the ground. Cross rail 507 is between rails 505 and 509 so that it is above and spans the width of the bed frame and box spring 119 and mattress 121. Bed support system 500 may include a bed frame coupled to first side rail 501, second side rail 503, third side rail 505 and fourth side rail 509 using first straps 105. Bed support system 500 may include box spring 119 coupled to a bed frame and first side rail 501, second side rail 503, third side rail 505 and fourth side rail 509. Bed support system 500 may include second straps 107 around first side rail 501, second side rail 503, third side rail 505 and fourth side rail 509 to further couple first side rail 501, second side rail 503, third side rail 505 and fourth side rail 509 to each other and to a bed frame and box spring 119. First and second straps 105 and 107 can be adjustably secured onto first side rail 501, second side rail 503, third side rail 505 and fourth side rail 509 using one or more double D-rings 106 and 108.

The legs of first side rail 501, second side rail 503, third side rail 505 and fourth side rail 509 are adjustable for the height of first side rail 501, second side rail 503, third side rail 505 and fourth side rail 509. Bed support system 500 can be used with any height bed and for any height person. First and second handles 102 and 104 are positioned at a height that is comfortable for the particular person's height. Non-slip feet 143 may be coupled to the legs.

In order to aid in getting in and out of bed, up and down from furniture, and otherwise maneuvering difficult areas, the handles 10 and 104 of first side rail 501 and second side rail 503, the rungs of third side rail 505, fourth side rail 509 and cross rail 507 can be gripped and used to push or pull oneself into, onto, up from, and out of a bed, furniture, or other area. First side rail 501, second side rail 503, third side rail 505 and fourth side rail 509 and cross rail 507 can be used to maneuver around once in or on the bed, furniture, or other area.

Turning to FIGS. 4-8 and for the exemplary purposes of this disclosure, bed support system 200 is shown as a standalone system as well. Bed support system 200 is similar to bed support system 100 as previously described. Bed support system 200 generally includes a first side rail 201, a second side rail 203, a first strap 105, and a second strap 107.

First and second rails 201 and 203 can be any type of rail, frame, or structure that is suitable for use as a support device. First rail 201 and second rail 203 may be positioned about the width of a bed apart as illustrated in FIGS. 5-8. The height of first and second rails 201 and 203 is adjustable via legs 209 and 21 ion rail 301 and legs 213 and 215 on rail 203, depending on the person using bed support system 200.

First strap 105 may be positioned around (e.g., wrapped around) first and second rails 201 and 203, so that first strap 105 anchors onto first and second legs 209 and 211 of first rail 301 and third and fourth legs 213 and 215 of second rail 203. As depicted, first strap 105 can be positioned near the ground (such as just below a bed frame). However, first strap 105 can be positioned anywhere along first and second rails 101 and 103 (e.g., further above the ground (such as above a bed frame 117 or above a box spring 119)). One or more D-rings, double D-rings, buckles, clips, or the like may adjustably hold first strap 105 securely together and around first rail 101 and second rail 103. Thus, by using for example double D-rings 106, first strap 105 is adjustable for any size bed. Double D-rings 106 allow first strap 105 to be securely tightened around first and second rails 201 and 203 and a bed frame 117 or under a bed frame 117). The height of first rail 201 is adjustable using the pin and hole adjustments on first and second legs 209 and 211 and the height of second rail 203 is adjustable using similar pin and hole adjustments on third and fourth legs 213 and 215.

A bed frame 117 may be positioned over first strap 105 and within first rail 201 and second rail 203 near first and second legs 209 and 211 and third and fourth legs of rail 203 (that is, first and second rails 201 and 203 are positioned on the outside of bed frame 117). First strap 105 securely anchors first and second rails 201 and 203 onto a bed frame.

A box spring or other type of mattress 119 may be positioned onto a bed frame and can aid in anchoring first strap 105 to first and second rails 201 and 203 and a bed frame 117. While not shown, a covering, bed skirt, or other accessory may be positioned onto box spring 119.

Double D-rings 108 may adjustably hold second strap 107 securely together and around first and second rails 201 and 203. By using double D-rings 108, second strap 107 is adjustable for any size bed. Double D-rings 108 allow second strap 107 to be securely tightened around first and second rails 201 and 203 (e.g., such as toward the upper portion or above first and second legs 209 and 211 and third and fourth legs 213 and 215, or directly above box spring 119). Second strap 107 can be positioned (e.g., wrapped around) anywhere along first and second rails 201 and 203.

Any further adjustments to first and second straps 105 and 107 can be made to securely anchor first and second rails 201 and 203 onto/against bed frame 117 and box spring 119, and to each other. A second mattress 121 can be positioned onto box spring 119 and over second strap 107 and can further aid in anchoring first strap 105 and second strap 107 to first and second rails 201 and 203, a bed frame, and box spring 119. While not shown, a covering, bed sheet, or other accessory may be positioned onto mattress 121.

Thus, bed support system 200 includes first rail 201 coupled to second rail 203 using first strap 105, where first and second rails 201 and 203 are upright or vertical to the ground and first strap 105 is parallel to the ground. Bed support system 200 may include a bed frame coupled to first and second rails 201 and 203 using first strap 105. Bed support system 200 may include box spring 119 coupled to a bed frame and first and second rails 201 and 203. Bed support system 200 may include second strap 107 around first and second rails 201 and 203 to further couple first and second rails 201 and 203 to each other and to a bed frame and box spring 119. First and second straps 105 and 107 can be adjustably secured onto first and second rails 201 and 203 using one or more double D-rings 106 and 108.

First and second legs 209 and 211 and third and fourth legs 213 and 215 are adjustable for the height of first and second rails 201 and 203. Bed support system 200 can be used with any height bed and for any height person. First and second handles 202 and 204 are positioned at a height that is comfortable for the particular person's height. Non-slip feet 143 may be coupled to first and second legs 209 and 211 and third and fourth legs 213 and 215.

In order to aid in getting in and out of bed, up and down from furniture, and otherwise maneuvering difficult areas, a first handle 202 of first rail 201 and/or a second handle 204 of second rail 203 can be gripped and used to push or pull oneself into, onto, and out of a bed, furniture, or other area. First handle 202 and/or second handle 204 can be used to maneuver around once in or on the bed, furniture, or other area.

For the exemplary purposes of this disclosure, any of the foregoing bed support systems may be combined or integrated with each other in any way to form any number and types of bed support systems. In this way, more than one set of rails, handles, etc. may be available to be used by a person for more versatility in getting in and out of, up and down from and otherwise maneuvering around a bed. Rails, handles, etc. can be placed at any point along the bed depending on the needs of the person using the bed. See for example FIGS. 2 and 4 for examples of combined or integrated bed support systems.

Further implementations are within the CLAIMS.

Specifications, Materials, Manufacture, Assembly

It will be understood that implementations are not limited to the specific components disclosed herein, as virtually any components consistent with the intended operation of a bed support system and method implementation may be utilized. Accordingly, for example, although particular components and so forth, are disclosed, such components may comprise any shape, size, style, type, model, version, class, grade, measurement, concentration, material, weight, quantity, and/or the like consistent with the intended operation of a bed support system and method implementation. Implementations are not limited to uses of any specific components, provided that the components selected are consistent with the intended operation of a bed support system and method implementation.

Accordingly, the components defining any bed support system and method implementation may be formed of any of many different types of materials or combinations thereof that can readily be formed into shaped objects provided that the components selected are consistent with the intended operation of a bed support apparatus, system, and method implementation. For example, the components may be formed of: rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, spring steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Various bed support system and method implementations may be manufactured using conventional procedures as added to and improved upon through the procedures described here. Some components defining bed support system and method implementations may be manufactured simultaneously and integrally joined with one another, while other components may be purchased pre-manufactured or manufactured separately and then assembled with the integral components.

Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that the assembly of bed support system and method implementations are not limited to the specific order of steps as disclosed in this document. Any steps or sequence of steps of the assembly of bed support system and method implementations indicated herein are given as examples of possible steps or sequence of steps and not as limitations, since various assembly processes and sequences of steps may be used to assemble bed support system and method implementations.

Use

Implementations of bed support systems are particularly useful in bed applications as previously explained. Implementations may help people who have difficulty moving, are disabled, or are injured, get in and out of bed, and otherwise maneuver while in bed. Implementations are stable when getting in and out of bed, anchor well to a bed, and are easy to assemble. Implementations incorporate easy assembly and installation to the bed, custom configuration to aid people of substantially all heights and weights, and mobility from one bed to another. Implementations allow for conventional use of a bed and use of a bed skirt, coverings, or other accessories. Implementations do not require modifications to a conventional bed, so that it is easy to use and compatible with all types and sizes of beds.

However, implementations are not limited to uses relating to beds. Rather, any description relating to bed applications is for the exemplary purposes of this disclosure, and implementations may also be used in a variety of applications with similar results, such as in other furniture applications (such as chairs for example) or any application depending on the need of the person using it.

In describing the installation, operation and use of bed support systems further, reference is made to FIGS. 5-8 and bed support system 200. Bed support system 200 may be installed as follows.

First, first rail 201 and second rail 203 may be positioned the width of a bed apart and in an upright or vertical position to the ground. Then first strap 105 may be positioned around first and second rails 201 and 203, so that first strap 105 anchors onto or around first and second legs 209 and 211 of first rail 201 and third and fourth legs 213 and 215 of second rail 203.

Double D-rings 106 may then be secured onto first strap 105 to securely hold first strap 105 around first rail 201 and second rail 203. Next, bed frame 117 may be positioned over first strap 105 and within first rail 201 and second rail 203 near first and second legs 209 and 211 and third and fourth legs 213 and 215.

First and second rails 201 and 203 may then be positioned on the outside of bed frame 117 and box spring 119 may be positioned onto bed frame 117 to aid in anchoring first strap 105 to first and second rails 201 and 203 and bed frame 117. Double D-rings 108 may then be secured onto second strap 107 (e.g., by sewing or otherwise attaching double D-rings 108 onto second strap 107) so that second strap 107 securely holds around first and second rails 201 and 203 and bed frame 117.

Mattress 121 may then be positioned onto box spring 119 and over second strap 107 to aid in anchoring second strap 107 to first and second rails 201 and 203.

In this manner, first strap 105 and second strap 107 are anchored to first and second rails 201 and 203, bed frame 117, and/or box spring 119.

Thus, a bed handle frame (e.g., first rail 201) has at least two legs (e.g., first and second legs 209 and 211) on the lower portion of the bed handle frame and connects at the top by a handle (e.g., first handle 202) such as in the figure or shape "A" with a flat top. Another bed handle frame (e.g., second rail 203) has at least two legs (e.g., third and fourth legs 213 and 215) on the lower portion of the bed handle frame and connects at the top by a handle (e.g., second handle 204) such as in the figure or shape "A" with a flat top. The bed handle frames could be made of aluminum tubing or other durable light weight product or material. Two bed handles (e.g., first and second handles 202 and 204) are used together on either side of the bed. Using a balance and counter balance system, the bed handles are secured to a bed frame 117 (e.g., Hollywood-style bed frame) with nylon webbing as a belt (e.g., first strap 105) and fastener (e.g., double D-rings 106) as a buckle. Of course, any type of bed frame or fastener can be used. This makes it very easy to tighten the bed handle frames to the bed after they are installed. The belt is placed around the four legs of the two bed handle frames (of course, any number of legs could be used). The belt circles under the bed at the lower end of the legs (e.g., first and second legs 209 and 211 and third and fourth legs 213 and 215). The bed frame 117 is placed where you want the bed to be on the ground. One or more mattresses or box springs are placed on the bed frame and a bed skirt may be applied if desired. A second nylon belt (e.g., second strap 107) is circled around the four legs of the "A" frame bed handle frames at a position above the bed skirt or the mattress or box spring (with or without a bed skirt). After the nylon belts have been tightened with a simple tug on the belts running through the double D-rings 106 and 108, a mattress and bedding can be placed on the bed frame or other mattress or box spring with no interference from the bed handles, bed handle frames, or the belts.

It will be understood that other bed support system implementations (e.g., bed support systems 100, 300, 400, and 500) may be installed in a similar fashion with similar steps. However, these other implementations are not limited to the specific order of steps as disclosed in this document for bed system 200. Any steps or sequence of steps of the installation of bed support system implementations indicated herein are given as examples of possible steps or sequence of steps and not as limitations, since various assembly processes and sequences of steps may be used to install bed support system implementations.

In places where the description above refers to particular implementations, it should be readily apparent that a number of modifications may be made without departing from the spirit thereof and that these implementations may be alternatively applied. The accompanying CLAIMS are intended to cover such modifications as would fall within the true spirit and scope of the disclosure set forth in this document. The presently disclosed implementations are, therefore, to be considered in all respects as illustrative and not restrictive, the scope of the disclosure being indicated by the appended CLAIMS rather than the foregoing DESCRIPTION. All changes that come within the meaning of and range of equivalency of the CLAIMS are intended to be embraced therein.

The invention claimed is:

1. A bed support system comprising:

a first rail comprising at least two legs connected at a top thereof by a first handle;

a second rail spaced apart from the first rail and comprising at least two legs connected at a top thereof by a second handle;

a first adjustable strap placed around a lower portion of the at least two legs of the first rail and the at least two legs of the second rail; and a second adjustable strap spaced above the first adjustable strap and placed around one of a middle portion and an upper portion of the at least two legs of the first rail and the at least two legs of the second rail.

2. The bed support system of claim 1 wherein the at least two legs of both the first and second rails are adjustable.

3. The bed support system of claim 1 wherein both the first and second rails comprise a substantially "A" shape with one of a flat and a curved handle.

4. The bed support system of claim 1 wherein the first and second rails are substantially vertical and the first and second straps are substantially horizontal.

5. The bed support system of claim 1 further comprising a side cross rail located between upper portions of the first and second rails so that it is above and spans a width of a bed frame.

6. The bed support system of claim 1 further comprising an overhead cross rail located between top portions of the first and second rails so that it is above and spans a width of a bed frame.

7. The bed support system of claim 1 further comprising at least one tray coupled to one of the first rail and the second rail.

8. The bed support system of claim 7 wherein the at least one tray can swivel.

9. The bed support system of claim 1 further comprising one of at least one drink holder and a hydration device coupled to one of the first rail and the second rail.

10. The bed support system of claim 1 further comprising at least one light coupled to one of the first rail and the second rail.

11. The bed support system of claim 1 further comprising at least one electrical outlet coupled to one of the first rail and the second rail.

12. The bed support system of claim 1 further comprising a foot step coupled to one of the first rail and the second rail.

13. A bed support system comprising:

a first vertical rail comprising at least two adjustable legs connected at a top thereof by a first handle;

a second vertical rail spaced apart from the first rail and comprising at least two adjustable legs connected at a top thereof by a second handle;

a first horizontal adjustable strap placed around a lower portion of the at least two legs of the first rail and the at least two legs of the second rail;

a second horizontal adjustable strap spaced above the first adjustable strap and placed around one of a middle portion and an upper portion of the at least two legs of the first rail and the at least two legs of the second rail;

a bed frame coupled to the first and second rails using the first strap; and one of a mattress and a box spring on top of the bed frame to aid in anchoring the first strap to the first and second rails, the mattress or the box spring coupled to the first and second rails using the first and second straps, wherein the first adjustable strap is placed adjacently below the bed frame, and wherein the second adjustable strap is spaced adjacently above the mattress or the box spring.

14. A method of installing a bed support system on a bed on a ground, the method comprising:

positioning a first adjustable strap around first and second rails so that the first strap anchors around first and second legs of the first rail and third and fourth legs of the second rail;

positioning a bed frame over the first strap and within the first rail and the second rail near the first and second legs and the third and fourth legs to aid in anchoring the first strap to the first and second rails;

positioning a box spring onto the bed frame; and positioning a second adjustable strap over the box spring and around the first and second rails so that the second strap anchors around first and second legs of the first rail and third and fourth legs of the second rail.

15. The method of claim 14 further comprising positioning a mattress onto the box spring and over the second strap to aid in anchoring the second strap to first and second rails.

16. The method of claim 14 further comprising cinching the first and second straps so that the first and second rails are held tight against at least the bed frame.

* * * * *